US006197401B1

(12) United States Patent
Ahn

(10) Patent No.: US 6,197,401 B1
(45) Date of Patent: Mar. 6, 2001

(54) CONCRETE INCLUDING A PLURALITY OF FIBER RINGS

(76) Inventor: Jeong Ho Ahn, 110-502, Daelim Apt., 501 Daebang-dong, Dongjak-ku, Seoul (KR)

( * ) Notice: Subject to any disclaimer, the term of this patent is extended or adjusted under 35 U.S.C. 154(b) by 0 days.

(21) Appl. No.: 09/293,983

(22) Filed: Apr. 19, 1999

(30) Foreign Application Priority Data

Apr. 17, 1998 (KR) ..... 98-13755

(51) Int. Cl.[7] ..... B32B 31/00

(52) U.S. Cl. ..... 428/105; 428/98; 428/105; 428/297.4; 156/157; 156/158; 52/649.1

(58) Field of Search ..... 156/157, 158; 428/105, 98, 297.4; 52/649.1

(56) References Cited

U.S. PATENT DOCUMENTS 5,846,364 * 12/1998 Policelli .

* cited by examiner

*Primary Examiner*—Richard Weisberger

(57) ABSTRACT

Disclosed is concrete comprising: a plurality of fiber rings for reinforcing a tensile strength of the concrete, each of the plurality of fiber rings forming a closed loop. The plurality of fiber rings included in concrete according to the present invention can remarkably increase a tensile strength of the concrete, are prevented from being entangled and poorly distributed, and do not hurt the human body and prevent an object from being damaged and thereby being broken.

4 Claims, 7 Drawing Sheets

CONCRETE INCLUDING A PLURALITY OF FIBER RINGS

BACKGROUND OF THE INVENTION

Field of the Invention

The present invention relates to concrete including a plurality of fiber rings, and more particularly, the present invention relates to concrete in which a plurality of fiber rings are included to prevent the concrete from being fractured due to cracks developed therein.

Generally, a composite material is made by mixing two or more materials, to maximally utilize advantages of the respective materials and to compensate for disadvantages of the respective materials. Among various composite materials, a fiber-reinforced composite material is prepared by a unidirectional mixing of long-fibers, mixing of woven-fibers, mixing of short-fibers or mixing of long-fibers and short-fibers, depending upon a reinforcing method by fibers. As materials for a substrate and a fiber of a fiber-reinforced composite material, polymer, metal, ceramic, concrete, etc. are mainly used.

Concrete, which is widely used in the fields of civil-engineering or architecture, has a certain brittleness so that it is apt to be fractured by tensile load or dynamic load. Further, concrete has a disadvantage in that it is difficult to suppress the formation and growth of cracks developed therein. In order to resolve these drawbacks of concrete, that is, to improve its mechanical property by increasing tensile strength and suppressing the formation and growth of local cracks, a plurality of linear fibers having a straight configuration are included in concrete in an irregularly distributed manner. This is called fiber-reinforced concrete or fiber concrete.

Referring to FIGS. 1A through 1C, three different configurations of linear fibers according to the prior arts are illustrated. A linear fiber 20*a,* which has a straight configuration with both ends bent, is shown in FIG. 1A. Another linear fiber 20*b,* which is partially curved on several spaced-apart points thereby to be deformed, is shown in FIG. 1B. Still another linear fiber 20*c,* for increasing adhesion force through bearing pressure by concrete, is shown in FIG. 1C. On the other hand, referring to FIG. 2, there is shown a cross-sectional view illustrating a state in which a plurality of linear fibers having various configurations, as shown in FIGS. 1A through 1C, are disorderly distributed in concrete.

As can be readily seen from the above descriptions, most fibers currently used as a reinforcing material for concrete have a basically straight configuration which may be partially changed in its cross-section.

However, the linear fibers of the prior arts, constructed as mentioned above, suffer from defects as described below. First, since the linear fiber has tensile strength which is much larger than pull-out strength, when cracks are formed and grown in the concrete, the linear fiber is likely to be pulled out rather than be fractured. According to this, because the linear fiber does not generate tensile force anymore, it cannot properly perform its original function of reinforcing tensile strength of the concrete. Second, especially in the case where concrete is used in building a road, since both ends of the linear fiber may be exposed to the outside, sharp ends of the linear fiber can hurt the human body and scratch an object, thereby breaking it. Third, because the linear fibers are apt to be entangled and poorly distributed, workability of the concrete is reduced and reinforcing effect by the linear fibers is deteriorated.

Particularly, in the case of a linear fiber, when cracks are formed in concrete, an angle between a lengthwise direction of the linear fiber and a cracking direction of the concrete varies, and according to this, pull-out strength of the linear fiber is changed. Referring to FIGS. 3A through 3C, there are shown cross-sectional views for explaining the phenomenon that pull-out strength of a linear fiber is changed as an angle between a lengthwise direction of the linear fiber and a cracking direction of concrete varies. First, FIG. 3A illustrates a situation in which a cracking direction C of concrete 10 or a cracking surface S of the concrete 10 is perpendicular to a lengthwise direction of a linear fiber 20, that is, $\theta_1=90°$. At this time, fracturing force Fs equals pull-out load P, and when the fracturing force Fs of the concrete 10 is larger than the pull-out load P of the linear fiber 20, the linear fiber 20 is pulled out from the concrete 10. Next, FIG. 3B illustrates another situation in which concrete 10 is cracked while defining an angle $\theta_2$ with respect to a lengthwise direction of a linear fiber 20. At this time, an equation, $Fs=P\cdot\sin\theta_2$, is established by relations between fracturing force Fs and pull-out load P in equilibrium of force. Consequently, since an inequality, $0<\sin\theta_2<1$, is given while the pull-out load P of the linear fiber 20 is constant, the linear fiber 20 is pulled out by the fracturing force which is smaller than that in FIG. 3A where $\theta_1=90°$. Also, while shearing force $P\cdot\cos\theta_2$, which is another component force of the pull-out load P, is offset by other linear fibers, it reduces the strength of the linear fiber 20. On the other hand, FIG. 3C illustrates still another situation in which a cracking surface S of concrete 10 is parallel to a lengthwise direction of a linear fiber 20, that is, $\theta_3=0$. At this time, since pull-out load P of the linear fiber 20 is 0, the linear fiber 20 cannot perform its original function of reinforcing tensile strength of concrete 10, at all. Actually, it is extremely rare for cracks of the concrete 10 to be generated in the direction which is perpendicular to the lengthwise direction of the linear fiber 20, and in most cases, the cracking surface S of the concrete 10 defines the angle $\theta_2$ with respect to the lengthwise direction of the linear fiber 20. In this circumstance, because the pull-out load of the linear fiber 20, which is applied to the concrete 10, is smaller by $\sin\theta_2$ than that in the case that $\theta_1=90°$, the linear fiber 20 included in the concrete 10 is pulled out by a smaller fracturing force. As a result, the linear fiber of the prior arts cannot sufficiently perform its original function of reinforcing tensile strength of concrete.

SUMMARY OF THE INVENTION

Accordingly, the present invention has been made in an effort to solve the problems occurring in the prior arts, and a primary object of the present invention is to provide concrete which includes a plurality of fiber rings which increase tensile strength of the concrete.

Another object of the present invention is to provide concrete which includes a plurality of fiber rings which are prevented from being entangled and poorly distributed.

Still another object of the present invention is to provide concrete which includes a plurality of fiber rings which do not hurt the human body and prevent an object from being scratched and thereby being broken.

In order to achieve the above objects, according to the present invention, there is provided concrete comprising: a plurality of fiber rings for reinforcing a tensile strength of the concrete, each of the plurality of fiber rings forming a continuous closed loop.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1A:
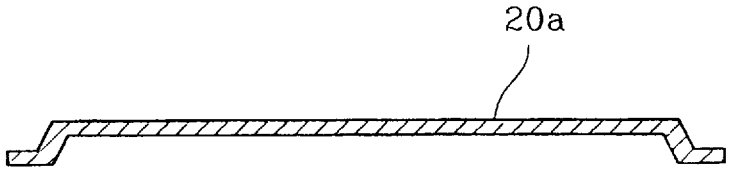
FIG.1A (PRIOR ART)
FIGS. 1A through 1C are cross-sectional views illustrating linear fibers according to the prior arts.
Figure 1B:
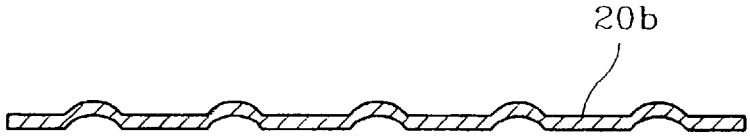
FIG.1B (PRIOR ART)
Figure 1C:
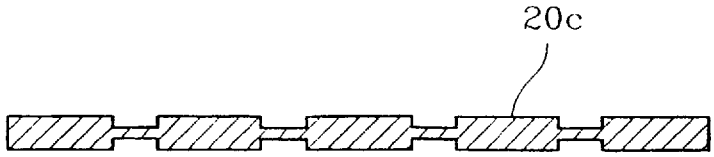
FIG.1C (PRIOR ART)
Figure 2:
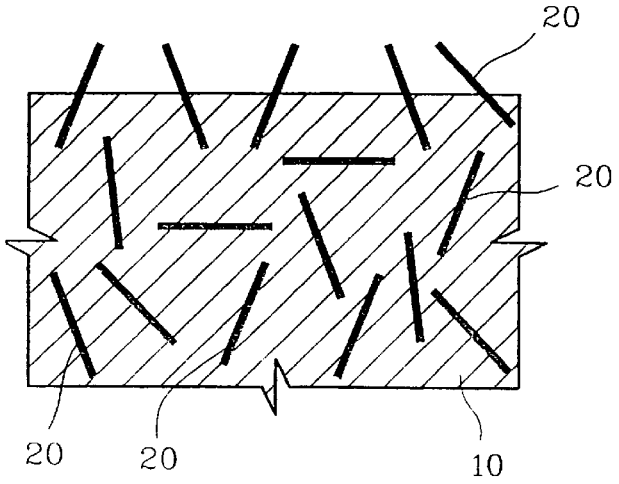
FIG.2 (PRIOR ART)
FIG. 2 is a cross-sectional view illustrating a state in which linear fibers are disorderly distributed in concrete.

Reference will now be made in greater detail to a preferred embodiments of the invention, examples of which are illustrated in the accompanying drawings. Wherever possible, the same reference numerals will be used throughout the drawings and the description to refer to the same or like parts.

Hereinafter, grounds why a fiber ring having a continuous closed loop configuration according to the present invention has remarkably increased tensile strength as compared to a linear fiber according to the prior arts, will be first explained, and then, embodiments of fiber rings will be described in detail with reference to the drawings.

As shown in FIGS. 4 through 8B, a preferred continuous closed loop is a circular loop. When enumerating advantages of the circular fiber, the circular fiber does not have a sharp portion, thereby does not hurt the human body nor damage an object. Also, while the linear fibers are apt to be entangled and poorly distributed, the circular fibers are difficult to be entangled and poorly distributed. The entanglement is basically caused when curvature is severely changed in a configuration of a fiber, the fiber is opened, or the ratio between a major axis and a minor axis in the case of a closed loop-shaped fiber is fairly large. In connection with this, because the circular fiber does not experience any variation in its curvature and is closed and the ratio between the major axis and the minor axis is 1, entanglement and poor distribution are not induced in the case of the circular fibers. The poor distribution is a phenomenon in which populations of fibers are non-uniformly distributed. In the case of circular fibers, because numbers of populations are reduced over the same volume due to its configuration as compared to the linear fibers, poor distribution is prevented.

Figure 5A:
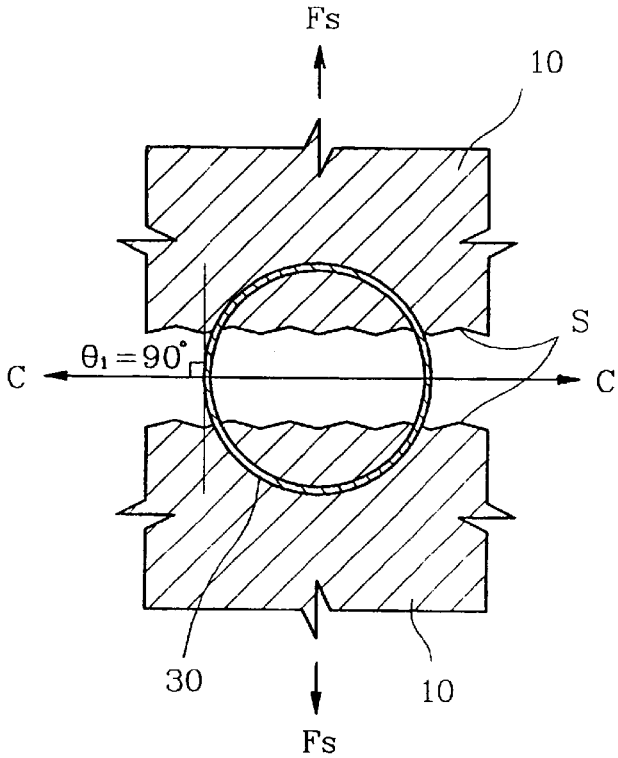
FIGS. 5A through 5C are cross-sectional views for explaining the fact that a tensile strength of a circular fiber is not changed because an angle between a tangential direction of the circular fiber and a cracking direction of concrete does not vary at all.
Figure 5B:
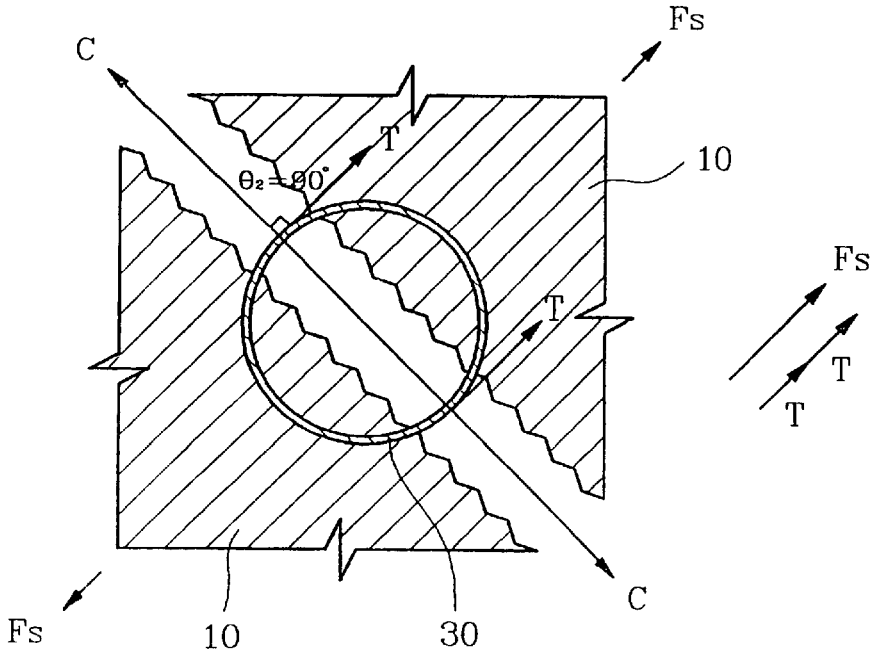
Figure 5C:
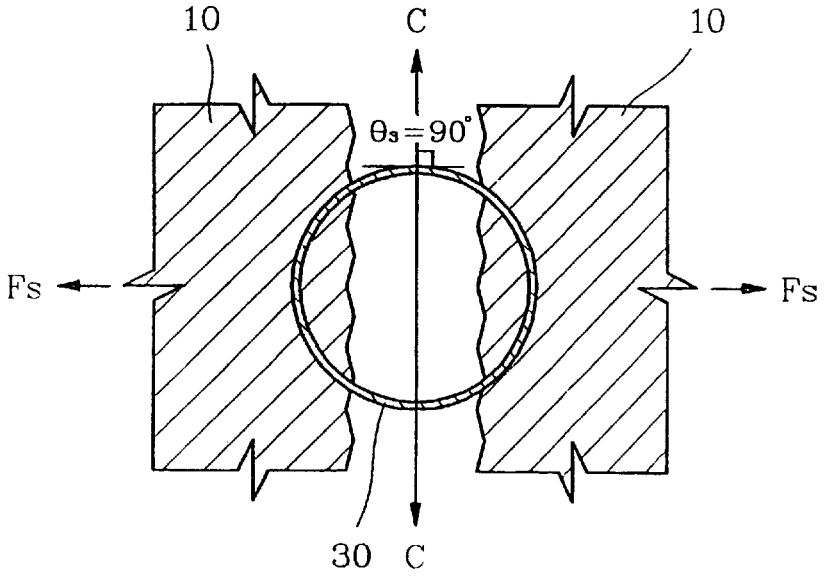

Next, descriptions will be directed to tensile strength of the circular fiber which is larger than that of the linear fiber. Referring to FIGS. 5A through 5C, in the case of circular fiber, when concrete 10 is fractured due to cracks developed therein, an angle between a cracking direction C of the concrete 10 and a tangential direction of the circular fiber is not changed, that is, $\theta_1=\theta_2=\theta_3=90°$. Accordingly, because the circular fiber is not influenced at all by a cracking direction of the concrete 10, its tensile strength reinforcing effect does not vary, contrary to the case of the linear fiber.

Figure 3A:
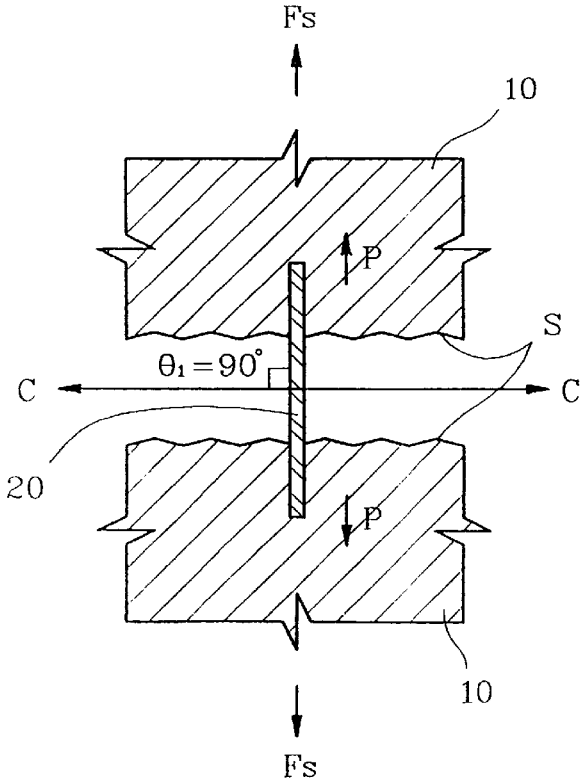
FIG.3A (PRIOR ART)
FIGS. 3A through 3C are cross-sectional views for explaining the fact that pull-out strength of a linear fiber is changed as an angle between a lengthwise direction of the linear fiber and a cracking direction of concrete varies.
Figure 3B:
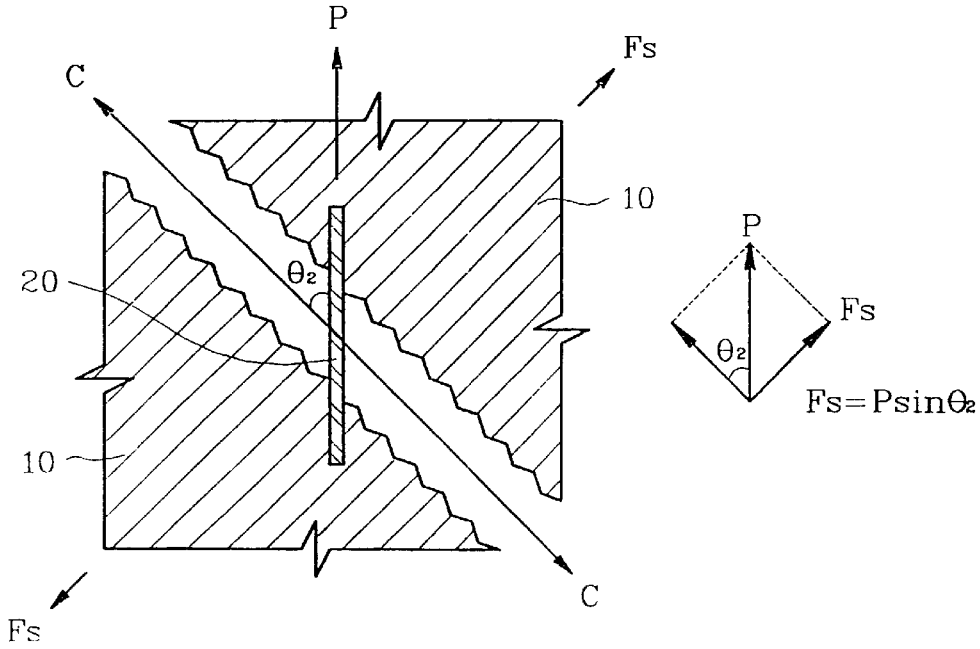
FIG.3B (PRIOR ART)
Figure 3C:
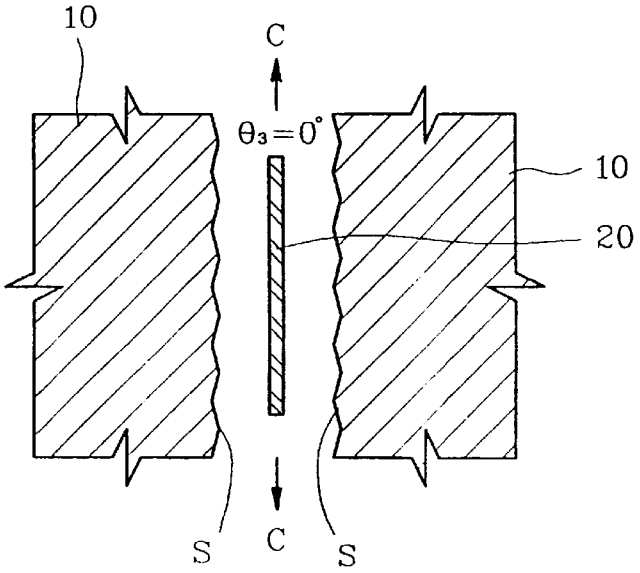
FIG.3C (PRIOR ART)
Figure 4:
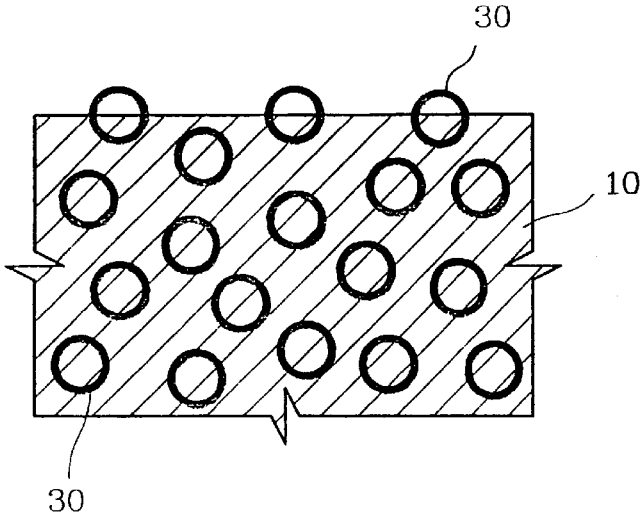
FIG. 4 is a cross-sectional view illustrating a state in which circular fibers in accordance with an embodiment of the present invention are arbitrarily distributed in concrete.

On the other hand, when cracked portions are connected by a circular fiber, the same effect as when they are connected by two linear fibers, is obtained. In connection with this, referring to FIG. 5B, when fracturing force Fs acts as the concrete 10 is cracked, two tensile forces each having a value of T are applied to both sides of the circular fiber, respectively. In other words, as an equation, Fs=2T, is satisfied with, the circular fiber applies a tensile force against the fracturing force of the concrete, with the tensile force being two times the tensile force which is applied by the linear fiber. In the case of the linear fiber, referring to FIG. 3A in which the linear fiber applies maximum tensile force, an equation Fs=P is satisfied with, wherein pull-out load P of the linear fiber is smaller than the tensile load T, that is, P<T. When a crack is generated as shown in FIG. 5C, while the tensile force is not changed in the case of the circular fiber, the linear fiber cannot apply any tensile force at all. Consequently, the circular fiber of the present invention remarkably increases tensile strength of the concrete as compared to the linear fibers of the prior arts.

Figure 6A:
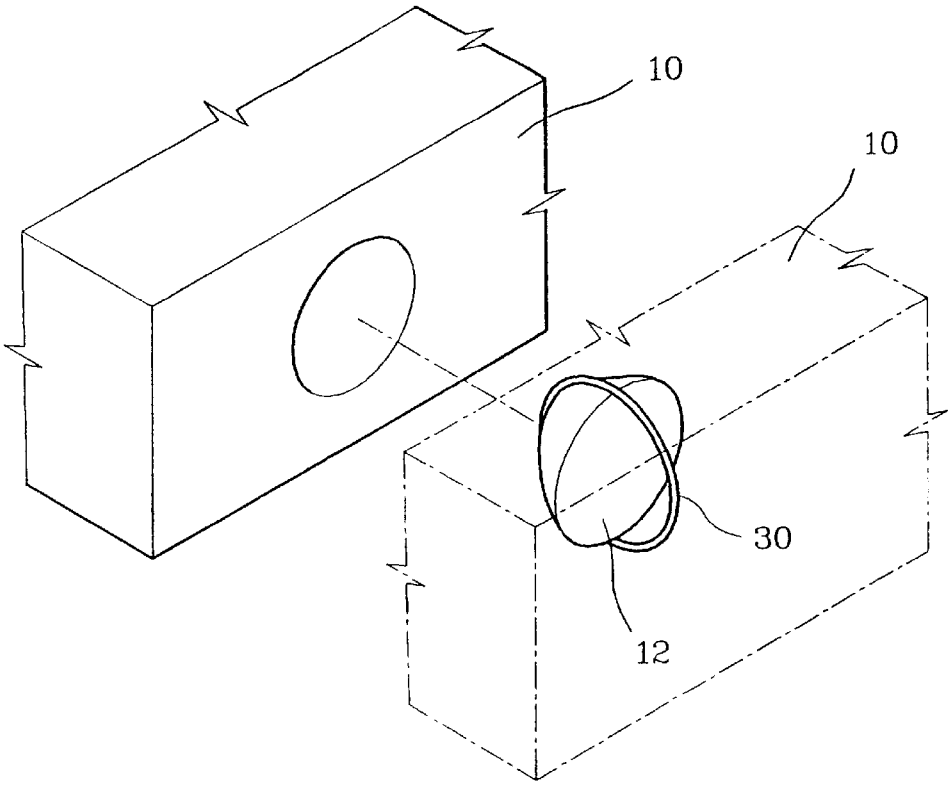
FIG. 6A is a perspective view illustrating a state in which the concrete is fractured without a fracturing of the circular fiber.

In the case of the circular fiber, pull-out load P does not exist. While tensile load T of a fiber is much larger than pull-out load P thereof, in the case of the linear fiber, since the linear fiber is pulled out from concrete before it is fractured, fracturing of the linear fiber does not occur. Behavior of the circular fiber is divided into two cases. In one case, concrete itself is fractured, and in the other case, the circular fiber is fractured without fracturing of the concrete. If the circular fiber is fractured on its both sides due to the fact that the fracturing force Fs of the concrete is fairly large, tensile strength reinforcing effect cannot be provided anymore. However, if the circular fiber is fractured on its one side, the circular fiber performs on its other side the same function as the linear fiber. Accordingly, in this case, although being decreased when compared to the circular fiber which is not fractured, tensile strength reinforcing effect which corresponds to that of the linear fiber, is maintained. In the case of the circular fiber according to the present invention, since tensile strength of the circular fiber is large, actually, the circular fiber is not fractured, and the concrete is first fractured. When the concrete is fractured by the circular fiber, as well known in the art, a conically shaped concrete piece 12 is segregated from the concrete as shown in FIG. 6A. Because fracturing energy of concrete is associated with fractured area of the concrete piece 12, the increase of the fractured area means the increase of the fracturing energy of the concrete. Accordingly, due to the fact that the concrete piece 12, which is segregated from the concrete to have the conical configuration, has a large fractured area, the circular fiber can secure a sufficient fracture-resistant force of the concrete by maximizing the fractured area which is associated with fracturing energy. Of course, it is to be readily understood that since the fracture-resistant force is remarkably larger than the pull-out strength of the linear fiber, when the concrete piece is segregated to have the conically shaped configuration, fracturing force Fs, which is remarkably larger than that in the case of the linear fiber, is already applied to the concrete.

Figure 6B:
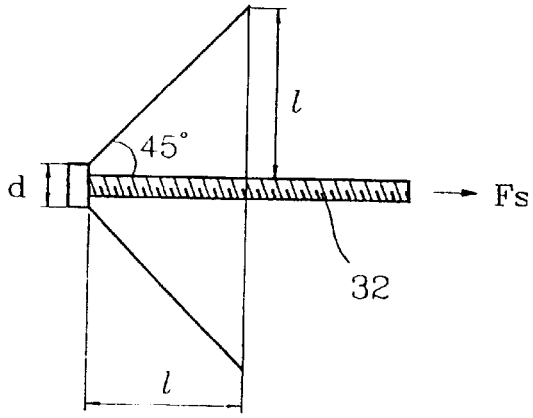
FIG. 6B is a schematic side view representing a fracturing force of concrete by the circular fiber.

Hereinafter, fracturing force of concrete will be described in detail with reference to FIG. 6B.

First, as being determined by adhesion strength, pull-out load P of a linear fiber can be represented by an equation $P=t_{max}\cdot\Sigma o\cdot l$, as is well known in the art. As mean adhesion strength, $t_{max}$ is experimentally about 8–20 kg/cm$^2$, So is the circumference of fiber cross-section, and l is the buried depth. As an example, when assuming that diameter d=0.5 mm, buried depth l=15 mm and $t_{max}$=20 kg/cm$^2$, since $\Sigma o=\pi\cdot d$, the pull-out load of the linear fiber $P=20\times\pi\times0.05\times1.5=4.7$ Kg.

Next, because concrete is fractured by a circular fiber to have a concrete piece of a conically shaped configuration, the fracturing of the concrete by the circular fiber can be analyzed while being considered as conical fracturing of the concrete. Accordingly, fracturing force of the concrete can be calculated by an empirical equation:

$$Fs = 1.05\cdot\sqrt{f_c'}\cdot A_{cp}$$

which is well known in the art and used in analyzing conical fracturing. In the above empirical equation, $A_{cp}$ is effective cross-sectional area, and in an anchor bolt 32 of FIG. 6B, $A_{cp}=\pi\cdot[(l+d/2)^2-(d/2)^2]$ and $f'_c$ is compressive strength of the concrete. As an example, when assuming that thickness of the circular fiber is 0.5 mm, diameter 2 l=30 mm, buried depth l=15 mm and $f'_c$=240 kg/cm$^2$, since l>>d/2, it can also be assumed that the effective cross-sectional area of the circular fiber $A_{cp}=\pi\times l^2$. Accordingly, the fracturing force of the concrete by the circular fiber can be calculated as below:

$$Fs = 1.05\times\sqrt{240}\times\pi\times1.5^2 = 115\text{ kg}$$

Based on the above calculations, because the pull-out load of the linear fiber is 4.7 kg and fracturing force of the circular fiber is 115 kg when the circular fiber is not fractured, the circular fiber has the fracture-resistant force which is 25 times that of the linear fiber. Consequently, the concrete including the plurality of circular fibers is not fractured by the conventional fracturing force by which the concrete including the plurality of linear fibers is fractured.

Figure 7:
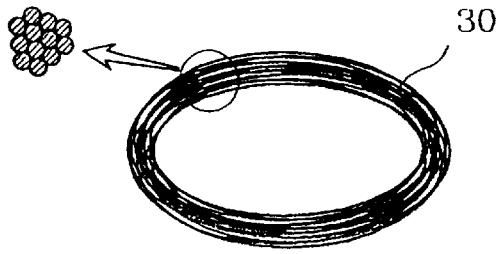
FIG. 7 is a perspective view showing another fiber in accordance with another embodiment of the present invention.
Figure 8A:
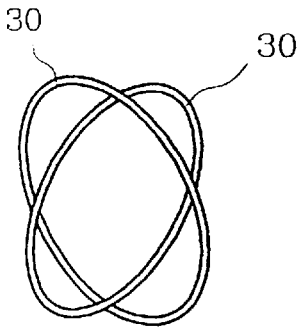
FIGS. 8A and 8B are perspective views showing still another fibers in accordance with still another embodiments of the present invention.
Figure 8B:
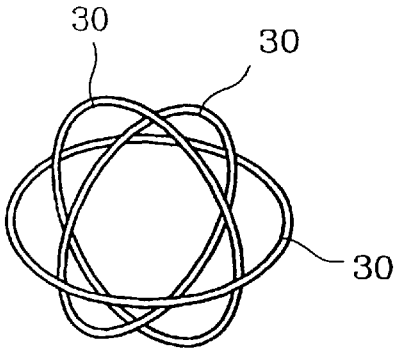

As another embodiment of the present invention, as shown in FIG. 7, a circular fiber which is made by repeatedly winding a long fiber can be included in concrete, and on the other hand, as shown in FIGS. 8A and 8B, two or three circular fibers can be joined with each other to be included in concrete. Because the fibers shown in FIGS. 8A and 8B define spaces, poor distribution phenomenon which may be induced in a single circular fiber, can be prevented, and also, tensile strength can be sufficiently increased with a small number of circular fibers. Further, since the fibers of FIGS. 8A and 8B form solid spaces, they can act on every crack in three-dimensional directions.

While the fiber is explained to have a circular configuration in the above embodiments, it is no more than an example. Therefore, the present invention is not limited to the circular fiber, and a fiber of another configuration which forms a closed loop can achieve the aforementioned objects of the present invention. Moreover, while it is explained that concrete used in the fields of civil-engineering or architecture is adopted as a substrate in the present invention, it is to be readily understood that not only concrete, but also various materials such as polymer, ceramic or the like can be used as the substrate.

As described above, a plurality of fiber rings included in concrete according to the present invention can remarkably increase a tensile strength of the concrete, are prevented from being entangled and poorly distributed, and do not hurt the human body and prevent an object from being damaged and thereby being broken.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. Concrete comprising:

a plurality of fiber rings for reinforcing a tensile strength of the concrete, said fiber rings being randomly distributed in the concrete and each of the plurality of fiber rings forming a continuous closed and circular loop.

2. The concrete as claimed in claim 1, wherein the plurality of fiber rings are located such that respective two fiber rings are joined to be perpendicular to each other.

3. The concrete as claimed in claim 1, wherein the plurality of fiber rings are located such that respective three fiber rings are joined to be perpendicular to one another.

4. The concrete as claimed in claim 1, wherein each of the plurality of fiber rings is made by repeatedly winding a long fiber.

* * * * *